United States Patent [19]

Borgert et al.

[11] Patent Number: 4,544,593

[45] **Date of Patent: * Oct. 1, 1985**

[54] SEALING STRIP

[75] Inventors: Bernhard Borgert; Udo Liche, both of Mannheim, Fed. Rep. of Germany

[73] Assignee: Braas & Co., Fed. Rep. of Germany

[ * ] Notice: The portion of the term of this patent subsequent to May 18, 1999 has been disclaimed.

[21] Appl. No.: 497,076

[22] Filed: May 23, 1983

[30] Foreign Application Priority Data

Jun. 2, 1982 [DE] Fed. Rep. of Germany ... 8215946[U]

[51] Int. Cl.[4] ..... B32B 3/02; E04C 1/00

[52] U.S. Cl. ..... 428/80; 52/58; 52/275; 52/309.1; 428/81; 428/174; 428/280; 428/284

[58] Field of Search ..... 428/81, 80, 174, 280, 428/284; 52/58, 96, 219, 309.1, 275

[56] References Cited

U.S. PATENT DOCUMENTS 4,330,581 5/1982 Bogert et al. ..... 428/174

FOREIGN PATENT DOCUMENTS 736647 6/1966 Canada .

*Primary Examiner*—Paul J. Thibodeau

*Attorney, Agent, or Firm*—Kenyon & Kenyon

[57] ABSTRACT

A sealing strip is provided which is suitable for sealing flat roofs and engineering structures at outer corners. The sealing element is made of a weather-resistant elastomer or plastomer and comprises, in a zone positioned intermediate its ends, at least one pair of areas in the form of oppositely directed waves whose amplitudes and wave-lengths increase regularly from the center line of the strip towards its longitudinal edges so that said zone comprises a planar basal surface and an additional curved a planar sectorial surface corresponding to each wave. The wave-shape areas enable the sealing element to be smoothly laid around an outer corner without straining any areas of the strip.

16 Claims, 3 Drawing Figures

SEALING STRIP

BACKGROUND OF THE INVENTION

This invention relates to a sealing strip made of weather-resistant elastomers or plastomers for outer corners on flat roofs and engineering constructions.

When sealing flat roofs and engineering constructions by means of plastics sheets, the sealing of corners against water, whether under pressure or not gives rise to serious problems. This is the case when sealing outer corners (i.e. angles of more than 180°) where two surfaces, which meet at an angle and are often mutually perpendicular, extend into an almost horizontal surface, as in the case of a structural part e.g. a chimney, being brought through a flat roof, and also when sealing inner corners (i.e. angles of less than 180°), where two mutually perpendicular surfaces meeting at an angle enclose a horizontal surface as a boundary.

Sealing strips made of a plastomer have already been used for the purpose of sealing outer corners. The sealing strips have to be greatly stretched before fitting in the transition area where the horizontal surface meets the upstanding surfaces, whether perpendicular or inclined, in order to permit a tight fit. Not only is the stretching of these sealing strips, which usually have a thickness of only 1 to 2 mm, carried out manually so that there is the danger that they will often tear, but a decrease in the thickness of the material will in any event occur in the corner-sealing areas, in which the sealing strips are most liable to damage. In addition, the stretching in these areas increases with increasing distance from the centre line of the sealing strip, thereby imposing a practical limitation on the width of these strips.

SUMMARY OF THE INVENTION

An object of this invention is to provide a sealing strip suitable for covering outer corners, which may be manufactured by deep drawing or pressing from a cut piece of planar material, and in which the stretching of the material occurring with the deep drawing or pressing is distributed as uniformly as possible over the entire width of the cut.

According to the present invention there is provided a sealing strip made of a weather-resistant elastomer or plastomer for outer corners on flat roofs and other engineering constructions which comprises, in a zone positioned intermediate its ends, at least one pair of areas in the form of oppositely directed waves whose amplitudes and wave-lengths increase regularly from the centre line of the strip towards its longitudinally extending edges, so that said zone comprises a planar basal surface and an additional curved aplanar sectorial surface corresponding to each wave.

DESCRIPTION OF THE PREFERRED EMBODIMENTS

The amplitudes and wave-lengths of the waves preferably increase in a linear manner from the centre of the strip towards the longitudinal edges of the strip.

By virtue of the aplanar part of the strip's structure, it is no longer necessary to increase the width of the sealing strip with a portion whose width increases over zones peripherally defined by arcs of circles to obtain the tight fit in the transitional areas where horizontal surfaces meet perpendicular or inclined surfaces; instead, the functions of such zones are provided by the waves formed in a strip whose width remains constant and which is produced from a sealing strip of constant width. Due to the elasticity of the material used, the sealing strip can be laid flat on the surfaces to be covered, and a tight fit is made possible in the transitional areas owing to the additional surface of the waves. In addition to making possible a uniform distribution of the material thickness at the transition areas, the new sealing strip has the advantage that its fitting position is easily established when it is placed with the planar basal portion of the wave-form zone at the lower end of the corner to be covered.

It has proved particularly advantageous to provide the sealing strip with a single pair of waves of equal size, which furnish the additional material required for the transitional areas. It is true that the same effect could also be achieved with a greater number of smaller waves, but these waves would then have to have a proportionally greater curvature which, during manufacture, leads to a greater stretching difference between the top and bottom side of the waves, which causes these smaller waves to have a greater structural inertia, so that they are less easy to lay smoothly when being fitted.

The amount of surface which the sealing strip of this invention is to possess in excess of that provided by a continuously planar sealing strip depends on both the angle between the lateral surfaces forming the corner and also the inclination of these surfaces relative to the basal surface. Most often, however, the lateral surfaces which form the corner meet at an angle of 90° so that the wave-form part of the sealing strip rising from the basal surface has to cover a circumferential arc of 270°. As basal surface sectors of 45° will remain on both sides of such a corner which is also formed by perpendicular lateral surfaces, and such surface sectors cannot be covered by a planar sealing strip without stretching it, in order to provide a proper fit in such a case each curved sectorial surface of wave form should correspond to an octant of a circle.

Preferably, the sealing strip is manufactured from soft-PVC or polyisobutylene and has a length of 500 to 700 mm, a width of 150 to 250 mm, and a thickness of 0.8 to 2 mm.

When sealing an outer corner at which the upstand height is typical of those encountered with bases for rooflights, (hereinafter termed an upstand) it is preferred to use a sealing strip in which the area including the waves is located at a distance of at least 100 mm from one end of the sealing strip so that this strip can provide a seal up to the upper edge of the upstand.

Finally, it has been found to be desirable when employing such a sealing strip for a synthetic non-woven fabric or felt of smaller area to be positioned on its underside in such a way as to leave free edge areas of at least 20 mm width. Such a synthetic felt can for example be bonded with an underlying sheet made of elastomer or plastomer material and prevents the transmission of stresses from the substructure to the sealing strip. The free edge areas of the sealing strip can be bonded with the underlying sheets to ensure a leakproof bond.

BRIEF DESCRIPTION OF THE DRAWINGS

For a better understanding of this invention and to show how the same can be carried into effect, reference will now be made by way of example only, to the accompanying drawings, wherein.

DETAILED DESCRIPTION OF THE DRAWINGS

Figure 1:
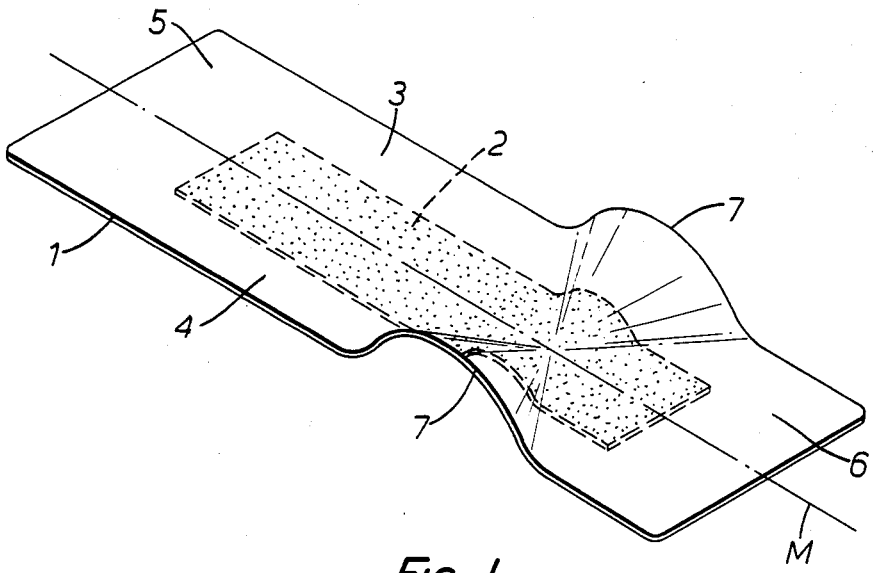
FIG. 1 shows a perspective view of a sealing strip of the invention with a single pair of waves of equal size.

FIG. 1 shows the sealing strip in the non-fitted state as it is obtained immediately after shaping. The sealing strip 1 is formed for example of soft-PVC or polyisobutylene. A synthetic felt 2 made of polyester is bonded to its underside. In a preferred embodiment the sealing strip has a length of approximately 620 mm, a width of approximately 200 mm, and a thickness, exclusive of the felt thickness, in the unstretched part of approximately 1.2 mm when soft-PVC is used or approximately 1.5 mm when polyisobutylene is used.

The synthetic felt 2 has a length of approximately 410 mm, a width of approximately 100 mm, and a thickness of approximately 1 mm, and is positioned in the middle of the underside of the sealing strip 1 so that edge areas 3 to 6 remain free for bonding the sealing strip with underlying sealing sheets (not shown).

As shown in FIG. 1 the sealing strip 1 has two opposite waves 7 of equal size positioned on opposite sides of the centre line M of the strip. The structure of the strip is such that stretching of the material in this area, which takes place during the surface enlargement by means of a deep drawing or pressing process, can be distributed without any special arrangements and in a uniform manner over the entire width of the strip. Therefore, the sealing strip can easily be manufactured from a planar material in a deep drawing or pressing mould which already has the indicated undulatory formation required by the strip 1.

Whereas a reduction in thickness of more than 50% relative to the starting thickness was observed in the area of the greatest stretching of material at the longitudinal edges with hitherto employed sealing strips, which were stretched manually at the required places, a maximum reduction of thickness at the longitudinal edges in the area of the waves of only approximately 10% can be achieved with the strips of the invention made of the same material. This means that sealing strips of the same width as hitherto can be manufactured from a starting material of lesser thickness, or wider strips can be produced with the same starting material.

Figure 2:
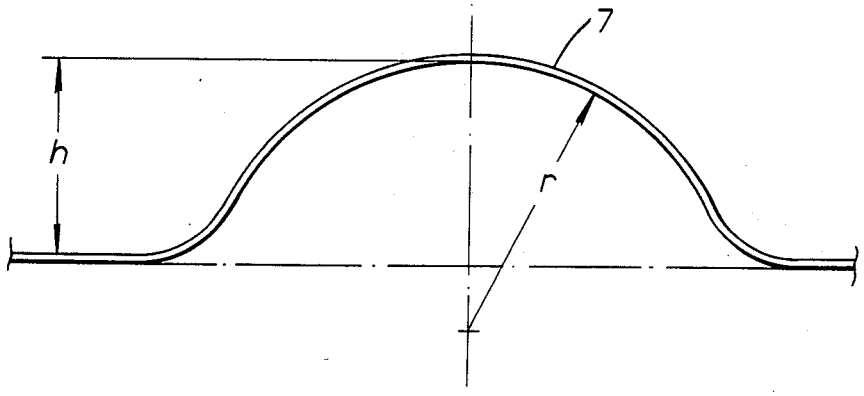
FIG. 2 shows the shape of the wave of the sealing strip of FIG. 1 at a longitudinal edge of the sealing strip.

In FIG. 2 the shape of the longitudinal wave-shaped edge portion of a sealing strip 1 according to FIG. 1 is shown. For a 200 mm wide strip to be suitable for fitting according to FIG. 3 a wave-formation with an amplitude h approximately 80 mm and a radius r approximately 100 mm is employed.

Figure 3:
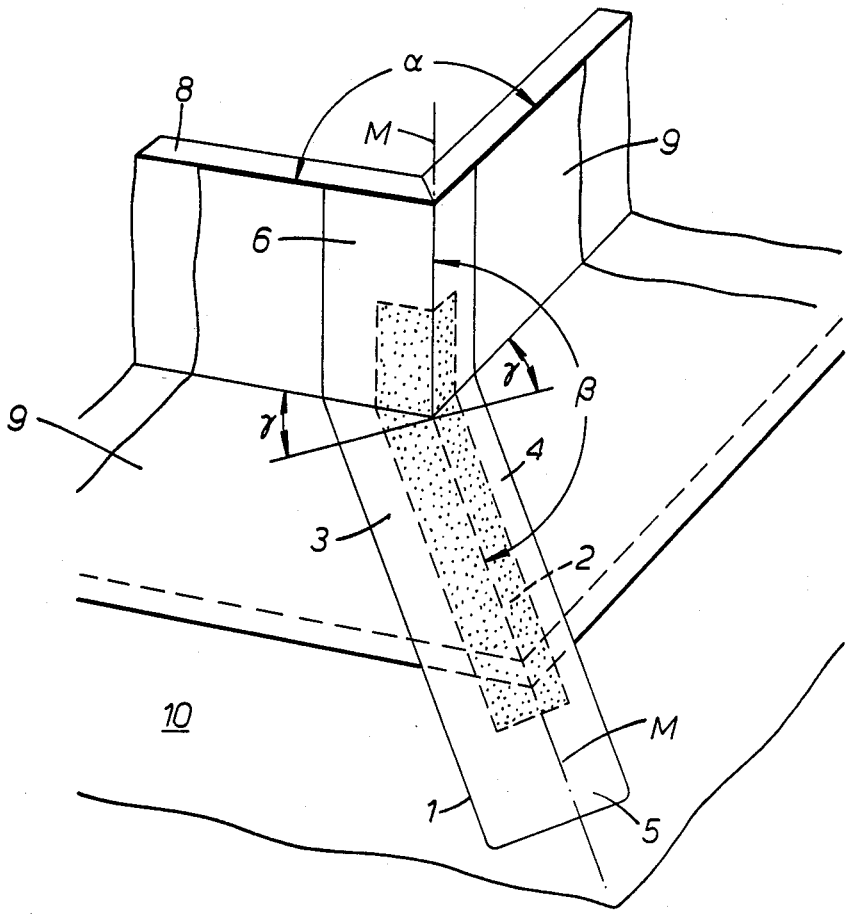
FIG. 3 shows in perspective view the fitting of the sealing strip of FIG. 1 at an outer corner of an upstanding base for rooflights.

The sealing strip 1 shown in FIG. 1 with the dimensions specified above can be shaped in such a manner that, as can be seen from FIG. 3, it lies smoothly on the outer corner of an upstand 8 for rooflights. Here the lateral surfaces forming the corner meet at an angle $\alpha$ of 90° and also the outer edge of the corner runs at an angle $\beta$ of 90° with respect to the basal surface. The sectorial surfaces, which are located at both sides of the corner on the basal surface and which enclose in each case an angle $\gamma$ at the centre of 45°, will be covered by virtue of the fact that each wave has a corresponding additional sectorial surface.

FIG. 3 also shows how the sealing strip 1, when being fitted, can be laid at the corner of the upstand base 8 for rooflights in such a way that the edge area 6 is in alignment with the upper edge of the upstand base. The synthetic felt 2 of the sealing strip is then for example bonded with connecting strips 9, which are made of PVC or polyisobutylene and bonded to the base, and with a sealing sheet 10 of the underlying structure, while the edge areas 3 to 6 of the strip 1 are bonded all around over a width of approximately 5 cm with the connecting strips 9 and with the sealing sheet 10 by solvent sealing whereby a leakproof and durable bond is obtained.

If the inclination of the lateral surfaces forming the outer edge of the corner differs from perpendicularity, as frequently occurs owing to lack of precision in forming the corner and as might occur for example in upstand bases for rooflights, it is possible to employ sealing strips in which each wave has an additional sectorial surface enclosing an angle at the centre which is less than 45°.

What is claimed is:

1. A sealing strip made of a weather-resistant elastomer or plastomer for outer corners on flat roofs and other engineering constructions, which comprises, in a zone positioned intermediate its ends, at least one pair of areas in the form of oppositely directed waves whose amplitudes and wave-lengths increase regularly from the centre line of the strip toward its longitudinally extending edges, so that said zone comprises a planar basal surface and an additional curved aplanar sectorial surface corresponding to each wave.

2. A sealing strip as claimed in claim 1, which contains one said pair of areas whose oppositely directed waves are of equal size.

3. A sealing strip as claimed in claim 2, wherein each sectorial surface corresponds to an octant of a circle.

4. A sealing strip as claimed in claim 1, which is formed of soft PVC or polyisobutylene.

5. A sealing strip as claimed in claim 4, which has a length of from 500 to 700 mm, a width of from 150 to 250 mm and a thickness of from 0.8 to 2 mm.

6. A sealing strip as claimed in claim 5, wherein said zone is located at a distance at least 100 mm from one end thereof.

7. A sealing strip as claimed in claim 1 which comprises, attached to its underside a synthetic non-woven fabric, which fabric occupies an area of the sealing strip such that edge areas of the sealing strip at least 20 mm wide remain free of said fabric.

8. A sealing strip made of soft PVC or polyisobutylene for corners of flat roofs and other engineering construction which comprises, in a zone positioned intermediate its ends, at least one pair of areas in the form of oppositely directed waves whose amplitudes and wave-lengths increase linearly from the centre line of the strip towards its longitudinally extending edges so that said zone comprises a planar basal surface and an additional aplanar sectorial surface corresponding to each wave.

9. A sealing strip as claimed in claim 8, which contains one said pair of areas whose oppositely directed waves are of equal size, each sectorial surface corresponding to an octant of a circle.

10. A sealing strip as claimed in claim 8, which has a length of from 500 to 700 mm, a width of from 150 to 250 mm and a thickness of from 0.8 to 2 mm and comprises, attached to its underside a synthetic non-woven fabric, which fabric occupies an area of the sealing strip such that edge areas of the sealing strip at least 20 mm wide remain free of said fabric.

11. A rectangular sealing strip of weather resistant material having at least one pair of areas in an intermediate zone defining oppositely directed waves, each said wave having an amplitude and a wave-length increasing from a center line of the strip towards a longitudinally extending edge thereof.

12. A rectangular sealing strip as set forth in claim 11 made of soft PVC.

13. A rectangular sealing strip as set forth in claim 11 made of polyisobutylene.

14. A rectantular sealing strip as set forth in claim 11 made of elastomer.

15. A rectangular sealing strip as set forth in claim 11 made of plastomer.

16. A rectangular sealing strip as set forth in claim 11 having a synthetic non-woven fabric bonded on an underside thereof.

* * * * *

UNITED STATES PATENT AND TRADEMARK OFFICE

CERTIFICATE OF CORRECTION

PATENT NO. : 4,544,593

DATED : October 1, 1985

INVENTOR(S) : BERNHARD BORGERT

It is certified that error appears in the above-identified patent and that said Letters Patent is hereby corrected as shown below:

In the Abstract, line 10 change "a planar" to -aplanar-

Signed and Sealed this

*Third* Day of *June 1986*

[SEAL]

*Attest:*

DONALD J. QUIGG

*Attesting Officer*

*Commissioner of Patents and Trademarks*